US010738439B2

(12) United States Patent
Mairet et al.

(10) Patent No.: US 10,738,439 B2
(45) Date of Patent: Aug. 11, 2020

(54) OPEN LOOP ELECTROHYDRAULIC BUCKET POSITION CONTROL METHOD AND SYSTEM

(71) Applicant: DEERE & COMPANY, Moline, IL (US)

(72) Inventors: Sean A. Mairet, Dubuque, IA (US); Todd F. Velde, Dubuque, IA (US); Nathan H. Laws, Dubuque, IA (US); Bryan Rausch, Durango, IA (US)

(73) Assignee: Deere & Company, Moline, IL (US)

( * ) Notice: Subject to any disclaimer, the term of this patent is extended or adjusted under 35 U.S.C. 154(b) by 315 days.

(21) Appl. No.: 15/875,017

(22) Filed: Jan. 19, 2018

(65) Prior Publication Data

US 2019/0226175 A1 Jul. 25, 2019

(51) Int. Cl.

| | |
|---|---|
| ***E02F 3/43*** | (2006.01) |
| ***E02F 9/20*** | (2006.01) |
| ***E02F 3/34*** | (2006.01) |
| ***E02F 3/42*** | (2006.01) |
| ***E02F 9/22*** | (2006.01) |

(52) U.S. Cl.

CPC ..... *E02F 3/431* (2013.01); *E02F 3/3414* (2013.01); *E02F 3/422* (2013.01); *E02F 9/2041* (2013.01); *E02F 9/22* (2013.01)

(58) Field of Classification Search

CPC ..... E02F 3/431; E02F 3/3414; E02F 3/422; E02F 9/2041; E02F 9/22

USPC ..... 701/50

See application file for complete search history.

(56) References Cited

U.S. PATENT DOCUMENTS

| | | | | |
|---|---|---|---|---|
| 3,924,766 | A * | 12/1975 | Canning | E02F 3/434 414/701 |
| 4,844,685 | A | 7/1989 | Sagaser | |
| 5,875,701 | A * | 3/1999 | Cobo | E02F 3/431 60/327 |
| 8,548,693 | B2 | 10/2013 | Numazaki et al. | |
| 9,304,501 | B2 | 4/2016 | Danko | |

(Continued)

FOREIGN PATENT DOCUMENTS

JP S 56163332 A 12/1981

*Primary Examiner* — Marthe Y Marc-Coleman

(74) *Attorney, Agent, or Firm* — Taft Stettinius & Hollister LLP; Stephen F. Rost

(57) ABSTRACT

An open loop electrohydraulic bucket position control system for a work vehicle having a positionable bucket coupled to a movable boom. The bucket control system maintains a position of the bucket with respect to a frame of the vehicle as the movable boom is raised or lowered. A bucket command, determined by an operator of the vehicle, is modified based on a pre-determined relationship of the work vehicle's hardware and known and constant properties of a linkage design of the work machine. The control system includes a processor and one or more look-up tables that include data identifying implement velocities with respect to boom commands and implement velocities with respect to bucket commands. Bucket commands are modified based on a relationship between the commanded velocity of the boom and a level orientation of the bucket during the commanded heights of the boom. Modified bucket commands and boom commands adjust the position of a bucket hydraulic cylinder and a boom hydraulic cylinder.

17 Claims, 4 Drawing Sheets

(56) References Cited

U.S. PATENT DOCUMENTS

| | | | | |
|---|---|---|---|---|
| 2010/0131158 | A1* | 5/2010 | Saito | E02F 9/2235 701/50 |
| 2015/0275469 | A1 | 10/2015 | Fredrickson et al. | |
| 2016/0153165 | A1 | 6/2016 | Singh et al. | |
| 2017/0036899 | A1 | 2/2017 | Singh et al. | |
| 2017/0268204 | A1* | 9/2017 | Shimano | E02F 3/32 |
| 2019/0194905 | A1* | 6/2019 | Matsuyama | E02F 3/43 |

* cited by examiner

OPEN LOOP ELECTROHYDRAULIC BUCKET POSITION CONTROL METHOD AND SYSTEM

FIELD OF THE DISCLOSURE

The present disclosure relates to a construction machine, such as a skid steer loader or a compact track loader, and more particularly to a control system for adjusting a position of a bucket.

BACKGROUND OF THE DISCLOSURE

Work machines, such as those in the agricultural, construction and forestry industries, perform a variety of operations. In some instances, the machines are provided with a work implement or tool to perform a desired function. The work implement or tool, such as a bucket, forklift, or grapple, is movably coupled to a frame of the machine by a mechanical lift arm or boom. The lift arm or boom is operably controlled by a machine operator using controls disposed in a cab of the machine.

In one instance, the machine may have a bucket operably connected to a boom which is rotatably coupled to a frame of the machine. In another instance, a boom is connected to the frame with two or more links. The operator of the machine adjusts the position of the boom as well as the position of the bucket to collect a material which can be located at a ground level or at other heights above ground level. Once the material is collected in the bucket, the material is moved to a desired location which can be at the ground level or at the other heights above ground level. The operator, in different embodiments of the work machine operably controls the bucket height and the bucket angle using one or more joysticks. In one embodiment, a boom joystick adjusts both a velocity and height of the boom and a bucket joystick adjusts both a velocity and level of the bucket.

Even though the operator provides commands with the boom joystick and the bucket joystick, known work vehicles include a control system which maintains the bucket level with respect to ground using one or more sensors which can include boom angle or position sensors and bucket angle or position sensors. Such systems incorporate what is known as a closed loop control system where the sensed position and velocity are transmitted to a controller and used to modify the commands provided by the operator through the joysticks.

Such systems are quite complex, however, due the presence of a large number of sensors which not only require maintenance but also require calibration. What is needed therefore is a work machine that maintains relatively the same level of performance, while reducing not only the number of sensors, but reducing the level of complexity of the control system maintaining bucket location and position.

SUMMARY

In one embodiment of the present disclosure there is provided an electrohydraulic bucket position control system for a work vehicle having a boom operator control configured to transmit a boom command to adjust a position of a boom and a bucket operator control configured to transmit a bucket command to adjust a position of a bucket. The control system includes a boom hydraulic actuator operatively connected to the boom operator control, a bucket tilt hydraulic actuator operatively connected to the bucket operator control, and a controller operatively connected to the boom operator control and to the bucket operator control. The controller includes a processor and a memory, wherein the memory is configured to store program instructions, bucket data, boom data, and boom and bucket relational data. The processor is configured to execute the stored program instructions to: determine a boom velocity of the boom based on the operator boom command; determine a bucket velocity of the bucket based on the operator bucket command; and determine a combined bucket command based on the boom velocity and bucket velocity to arrive at a combined bucket command, wherein the bucket velocity is at least one of an angular velocity and a linear velocity.

In another embodiment, there is provided a front end loader including a frame and a ground engaging traction member operatively connected to the frame. The cab is operatively connected to the frame and is configured to be occupied by an operator. A boom is operatively connected to the frame. A bucket is rotationally coupled the boom. A bucket tilt hydraulic actuator is operatively connected to a bucket operator control providing a bucket command and a boom hydraulic actuator is operatively connected to a boom operator control providing a boom command. A controller is operatively connected to the boom operator control and to the bucket operator control, wherein the controller includes a processor and a memory. The memory is configured to store program instructions and the processor is configured to execute the stored program instructions to: determine a velocity of the boom based on the boom command generated by the boom operator control; determine a velocity of the bucket based on the bucket command generated by the bucket operator control; determine a commanded boom and bucket velocity ratio based on the boom command; determine a required boom and bucket ratio for a level lift; determine a combined bucket command based on the commanded boom and bucket ratio and the required boom and bucket ratio; and adjust the bucket hydraulic actuator with the combined bucket command.

In a further embodiment there is provided a method of adjusting a position of an implement operatively connected to a boom of a front end loader wherein a position of the implement is made in response to a boom command and the position of the implement is made in response to an implement command. The method includes: identifying a first velocity of the boom based on the boom command; identifying a second velocity of the implement based on the bucket command; determining a commanded velocity ratio based on the first velocity and the second velocity; and determining a modified implement command based on the commanded velocity ratio, wherein the modified implement command adjusts the position of the implement with respect to the first and second boom arms.

The control system includes a processor and one or more look-up tables that include data identifying implement velocities with respect to boom commands and implement velocities with respect to bucket commands. Boom commands are modified based on a relationship between the commanded velocity of the boom and a level orientation of the bucket during the commanded heights of the boom. Modified velocity commands and unmodified operator commands adjust the position of a bucket hydraulic cylinder and a boom hydraulic cylinder.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
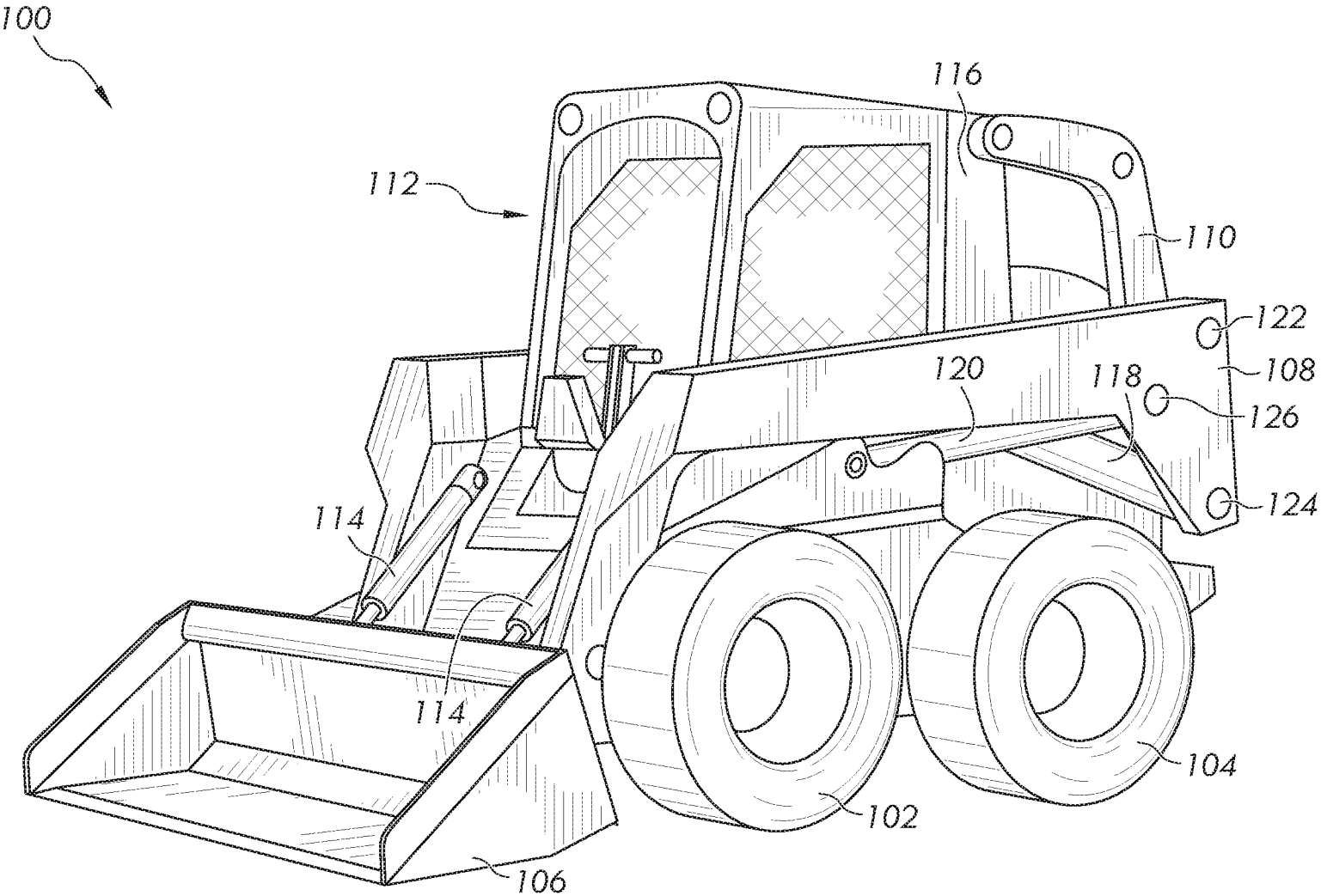
FIG. 1 is a side perspective view of a skid steer loader machine.

Referring to FIG. 1, an exemplary embodiment of a machine, such as a skid steer loader 100, is shown. This disclosure is not intended to be limited to a skid steer loader, however, but rather may include any agricultural, construction, or forestry machinery. The present disclosure is also directed to front end loader having a ground engaging traction member, including wheels or tracks, and lift or boom arms having pivot locations located behind or in front of an operator of the vehicle. The skid steer 100 includes a ground-engaging mechanism for moving along the ground. In FIG. 1, the ground-engaging mechanism includes a pair of front wheels 102 and a pair of rear wheels 104. In another aspect, such as a compact track loader, the ground-engaging mechanism can be a drive track disposed on each side of the machine. In a conventional skid steer, the operator manipulates machine controls from inside a cab 112 to drive the wheels on the right or left side of the machine 100 at different speeds to thereby steer the machine 100 in a conventional manner.

The machine 100 can be further provided with a work implement or tool for performing a desired operation. In FIG. 1, the skid steer 100 includes an implement, such as a loader bucket 106, for collecting material therein and transporting said material to a desired location. The loader bucket 106 can be pivotally coupled to a forward portion of a pair of boom arms 108 positioned on each side of the machine 100. A pair of bucket tilt hydraulic actuators 114 can extend between the bucket 106 and the boom arms 108 for controlling the tilted orientation of the bucket 106 with respect to the boom arms 108. Each hydraulic actuator 114 can include a cylinder rod that actuates back and forth within a cylinder in response to a change in hydraulic pressure. By actuating the tilt hydraulic actuators 114, the operator can tilt the bucket 106 for dumping material therefrom. The term "boom arm" and "boom" are used interchangeably throughout.

In FIG. 1, the loader bucket 106 is shown at a minimum height. To raise the bucket 106, each of a pair of boom arms of the boom 108 is connected to an upper link 110 at a first location 122 and a lower link 118 at a second location 124. The upper link 110 and lower link 118 are also attached to a main frame 116 of the skid steer 100 at opposite ends of where each connects to the boom arm 108. A boom hydraulic actuator 120 is pivotally secured at one end to the main frame 116 and coupled to the boom arm 108 at an opposite end thereof. The hydraulic actuator 120 connects to the boom arm 108 at a third location 126. The first location 122, second location 124, and third location 126 are each approximately equidistantly spaced from one another. In other embodiments, the spacing between the first location 122, the second location 124, and the third location 126 are spaced apart and arranged in other configurations.

On each side of the machine, a boom arm of the boom 108 is pivotally coupled to the upper link 110, lower link 118, and hydraulic actuator 120. As the hydraulic actuator 120 actuates between an extended position and a retracted position, the bucket 106 is correspondingly raised and lower with respect to the main frame 116. The bucket 106 is rotatably coupled to the end of the boom 108 which is fixedly coupled to the tilt actuators 114. Extension and retraction of the tilt actuators 114 adjusts the position of the bucket 106 with respect to the boom 108.

Figure 2:
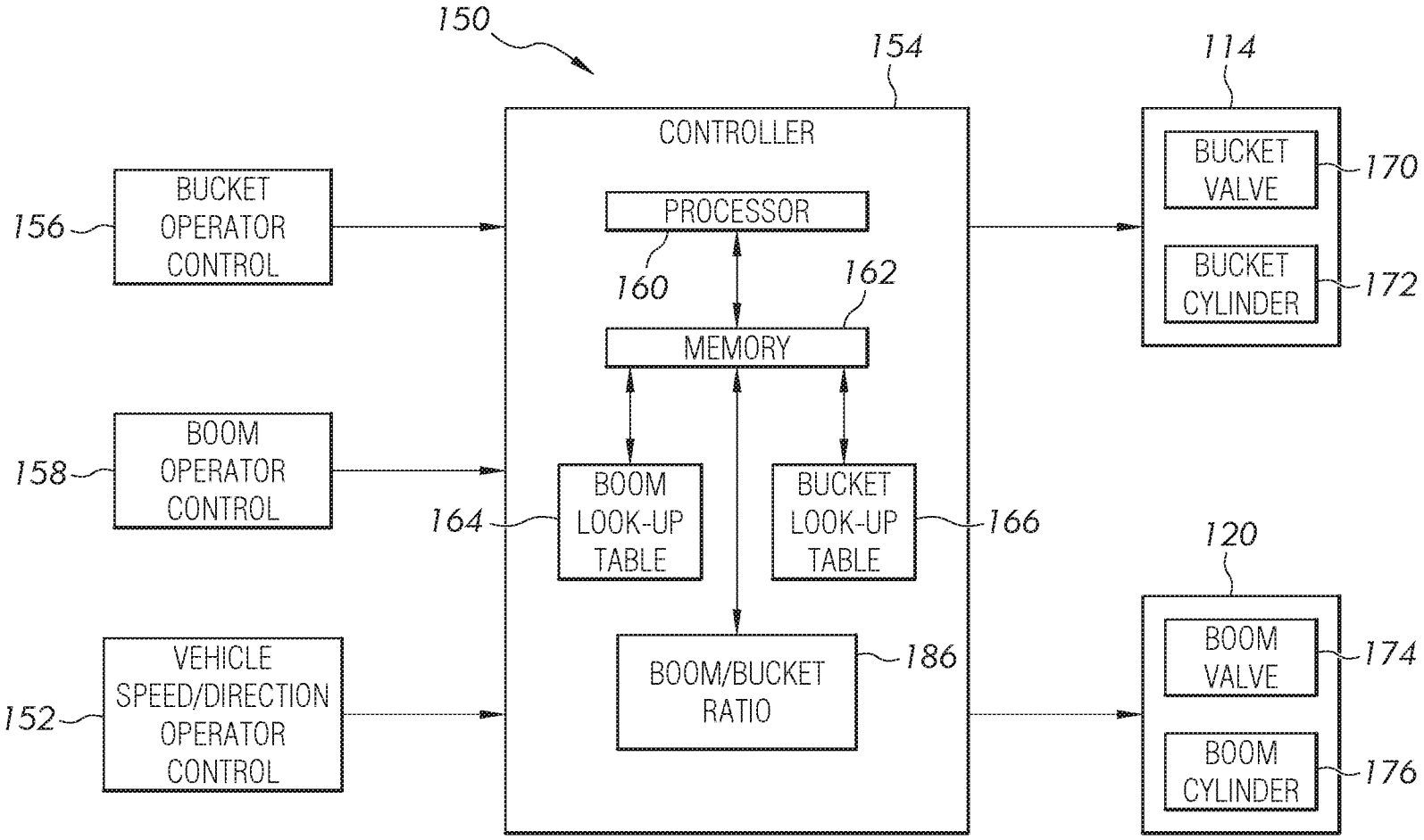
FIG. 2 is a block diagram of a control system for a loader machine.

FIG. 2 illustrates one embodiment of a control system 150 configured to operate a vehicle including controlling the speed and direction of a vehicle, such as vehicle 100, as well as the height and tilt of the bucket 106. The control system 150 includes one or more user controls located at a control panel located in the cab 112 of the vehicle for use by the operator. The user controls include, include but are not limited to, a vehicle speed and/or direction control 152, located within the cab 112, which is operatively connected to a controller 154. The controller 154 is located in or on the vehicle 100 and is typically located within the cab 106.

A bucket operator control 156, such as a joystick, is operatively connected to the controller 154 and provides a control signal or command signal that varies based on the location of the joystick as adjusted by the operator. The bucket operator control 156 adjusts the position of the bucket 106 with respect to the boom 108. A boom operator control 158, such as a joystick, is also operatively connected to the controller 154 and provides a control signal or command signal that varies with based on the location of the joystick as adjusted by the operator. The boom operator control 158 adjusts the position of the boom 108. While the operator controls 156 and 158 are often a joystick, each of the controls in different embodiments includes a button, a switch, a lever, a knob, or other means for sending an electrical signal to the controller 154. Additional controls may be provided for the machine operator to communicate with the controller 154.

The controller 154, in one or more embodiments, includes a processor 160 operatively connected to a memory 162. In still other embodiments, the controller 154 is a distributed controller having separate individual controllers distributed at different locations on the vehicle. In addition, while the controller is generally hardwired by electrical wiring or cabling to related components, in other embodiments the controller includes a wireless transmitter and/or receiver to communicate with a controlled or sensing component or device which either provides information to the controller or transmits controller information to controlled devices.

The controller, in different embodiments, includes a computer, computer system, or other programmable devices. In other embodiments, the controller 154 includes one or more processors 160 (e.g. microprocessors), and an associated memory 162, which can be internal to the processor or external to the processor. The memory 162 can include random access memory (RAM) devices comprising the memory storage of the controller 154, as well as any other types of memory, e.g., cache memories, non-volatile or backup memories, programmable memories, or flash memories, and read-only memories. In addition, the memory can include a memory storage physically located elsewhere from the processing devices and can include any cache memory in a processing device, as well as any storage capacity used as a virtual memory, e.g., as stored on a mass storage device or another computer coupled to controller 154. The mass storage device can include a cache or other dataspace which can include databases. Memory storage, in other embodiments, is located in the "cloud", where the memory is located at a distant location which provides the stored information wirelessly to the controller 154.

The controller 154 executes or otherwise relies upon computer software applications, components, programs, objects, modules, or data structures, etc. Software routines resident in the included memory of the controller 154 or other memory are executed in response to the signals received. The computer software applications, in other embodiments, are located in the cloud. The executed software includes one or more specific applications, components, programs, objects, modules or sequences of instructions typically referred to as "program code". The program code includes one or more instructions located in memory and other storage devices which execute the instructions resident in memory, which are responsive to other instructions generated by the system, or which are provided at a user interface operated by the user. The processor 160 is configured to execute the stored program instructions as well as to access data stored in one or more data tables including a boom lookup table 164 and a bucket lookup table 166.

The controller 154 is operatively connected to the bucket actuators 114 and the arm actuators 120. In one embodiment, as illustrated in FIG. 2, the bucket actuator 114 includes a bucket valve 170 operatively connected to the controller 154 to receive control signals generated by the processor 160. In one embodiment, the bucket valve 170 is a 2-way, solenoid-operated directional spool valve. The bucket valve 170 is operatively connected to a bucket cylinder 172, which in one embodiment is a two way hydraulic cylinder. The signal from the controller 154 to the bucket valve 170 directs the cylinder 172 to tilt in one of two directions, either upward or downward depending on the directional input provided by the operator through the bucket operator control 156. A source of hydraulic fluid for the cylinders is not shown.

The arm actuator 120 includes an arm valve 174 operatively connected to the controller 154 to receive control signals generated by the processor 160. In one embodiment, the arm valve 174 is a 2-way, solenoid-operated directional spool valve. The sump valve 174 is operatively connected to an arm cylinder 176, which in one embodiment is a two way hydraulic cylinder. The signal from the controller 154 to the arm valve 174 directs the cylinder 176 to raise or lower the boom arms 108, which in turn raises or lowers the bucket 106 depending on the directional input provided by the operator through the arm operator control 158.

While FIG. 2 illustrates a single valve operatively connected to a single bucket cylinder for each of the tilt actuators and boom actuators. In practice, the tilt actuators include a single valve hydraulically connected to two cylinders. Similarly, the arm actuators include a single valve hydraulically connected to two cylinders. Each of the valves is configured to controllably adjust the position of the connected cylinder. The present disclosure, however, is not limited to the described arrangement, and other configurations are contemplated.

Figure 3:
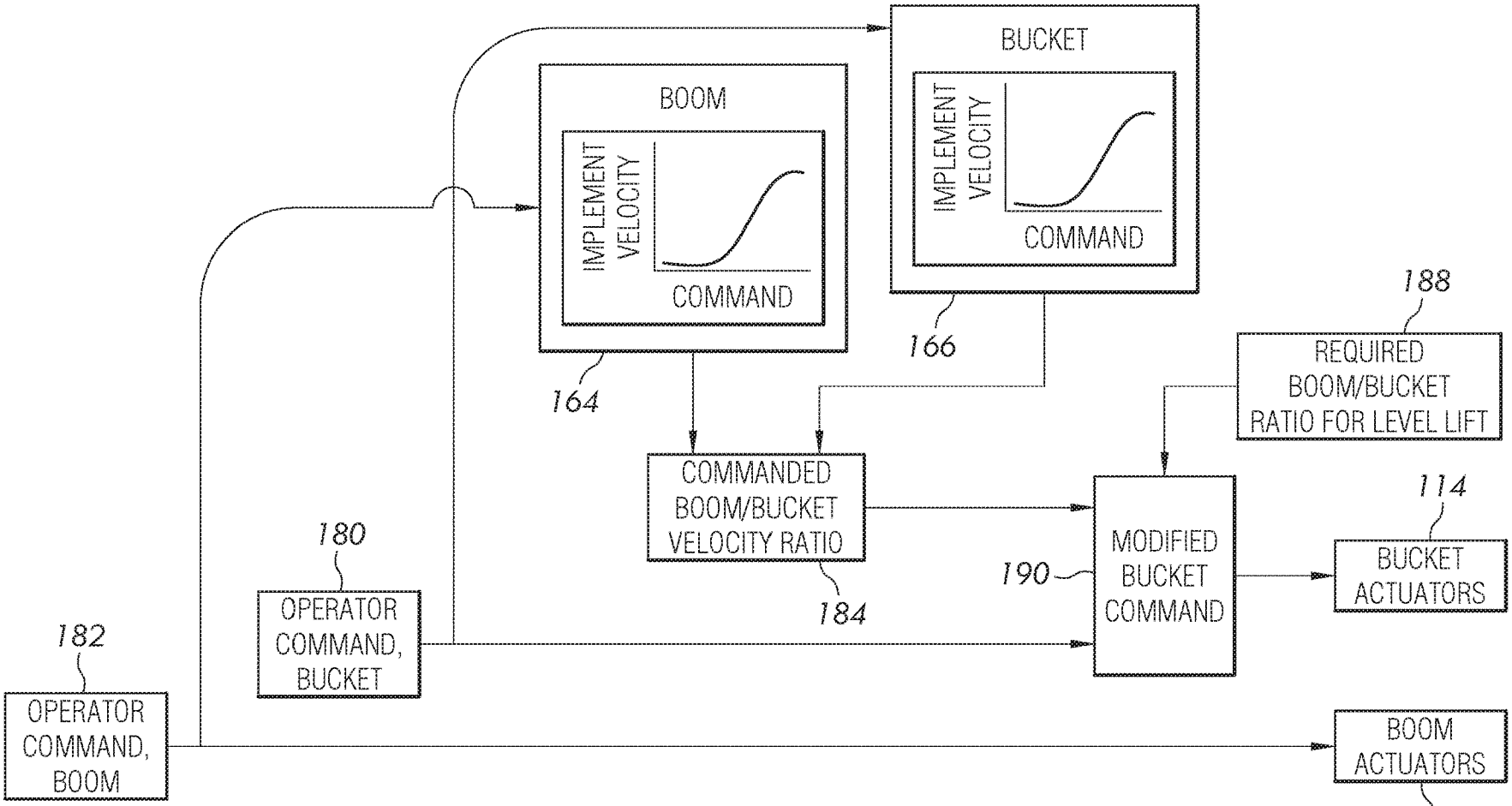
FIG. 3 is a flow diagram of one embodiment for controlling the position of a bucket of a loader machine.

FIG. 3 illustrates a flow diagram of a process to adjust the position of the bucket during movement of the boom 108 using an open loop position control system. The open loop control system maintains a position of the bucket throughout the lift path. As described with respect to FIG. 2, the bucket operator control 156 provides a bucket control signal or bucket command 180 to the controller 154. The bucket command 180 includes two different types of tilt commands. The first is a dump command that tilts the bucket away from the operator to dump the material. The second is a curl command that tilts the bucket toward the operator, typically used to load a bucket with material.

The boom operator control 158 provides a boom control signal or boom command 182 to the controller 154 as well. Each of these controls provides for the accurate adjustment of the bucket 106 with respect to the main frame 116. The control signals or commands are also understood as machine instructions including data configured to provide an instruction to the processor 160.

The controller 154 receives the bucket command 180 and the boom command 182, each of which is processed by the processor 168 and which accesses the appropriate look-up table 164 or look-up table 166 stored in the memory 162. The boom look-up table 164 includes data which represents a value of a boom command and a related boom velocity which occurs in response to the boom command. The data representative of the boom command and boom velocity is determined based on intrinsically derived data based on the values of the boom command, the distance travelled by the boom, and the velocity of the boom made in response to the boom command. In one embodiment, the derived data is determined based on the actual movement of a boom with respect to a plurality of boom commands. In another embodiment, the derived data is determined based on the results of a computer simulation representing the response of the boom to the boom commands. Different computer simulations are contemplated to provide the derived relational data including, but not limited to, a complete linkage geometry of the moving arms, boom, and actuators, a detailed physics based model of the hydraulic system, and a control system model, all of which run together in a simulation.

The derived data includes a number of different boom commands each of which is associated with a specific linear velocity of the boom, such as: i) a first boom command is associated with a first linear velocity; ii) a second boom command is associated with a second linear velocity; iii) a third boom command is associated with a third linear velocity; and so on. The number of commands (or points in a lookup table) provided by the control system is based on the resolution needed to accurately move the boom. Other factors such as cost, complexity of the final control system, maintenance, and repair are also taken into consideration. In one embodiment, the number of commands is between approximately 10 to 20 commands. In other embodiments, other numbers of commands or points are contemplated.

The bucket command 180 is an operator provided command processed by the processor and which accesses the bucket look-up table 166 from the memory 162. The bucket look-up table 166 includes data which represents a value of a bucket command and a related bucket velocity which occurs in response to the bucket command. The data representative of the bucket command and bucket velocity is determined based on intrinsically derived data based on the values of the bucket command, the angular distance travelled by the bucket, and the angular velocity of the bucket made in response to the bucket command. In one embodiment, the derived data is determined based on the actual movement of a bucket with respect to a plurality of bucket commands. In another embodiment, the derived data is determined based on the results of a computer simulation representing the response of the bucket to the bucket commands. The derived data includes a number of different bucket commands each of which is associated with a specific bucket angular velocity, such a first boom command is associated with a first angular velocity, a second boom command is associated with a second angular velocity, a third boom command is associated with a third angular velocity, and so on. In different embodiments, each of the commands is associated with single point or memory location of a lookup table.

Once the processor 160 accesses the appropriate values of the boom velocity and the bucket velocity, those values are stored in memory, at least temporarily, by the processor at block 184 of FIG. 2.

A stored boom/bucket ratio 186, which is stored in the memory 162, is accessed by the processor 160. As the boom is raised or is lowered, the angular displacement of the bucket with respect to the boom changes, but a ratio of boom angle to bucket angle remains relatively the same and is represented by the stored boom/bucket ratio to maintain a level lift and to prevent the material from falling from bucket until requested by a bucket command.

In one embodiment, the stored boom/bucket ratio 186 includes a single ratio which is the same for both raising and lowering of the boom. In another embodiment, the stored boom/bucket ratio 186 includes two ratios, one for raising the boom and the other for lowering boom. In other embodiments, the ratios or ratios are not stored in look-up tables but are instead stored in memory at a predetermined memory address or addresses or other database or databases.

The ratio look-up table 186 includes data based on a known and constant property of the machines linkage design, which includes the length of the boom 108, the distance moved by the boom 108 from zero (ground) to a maximum height, the bucket angular displacement from a predefined axis of zero rotation to an angular displacement of maximum angular displacement in either direction about the predefined axis of the bucket, and a correspondence between a height of the boom associated with a position of the bucket to maintain a level lift.

The level lift is defined, in part, by the type of bucket, as well as movement of the boom 108 throughout the movement. For example, the angular displacement of the bucket about a predetermined angle of inclination changes with respect to changing height or elevation of the boom. Adjustment of the bucket angle with respect to the boom is required to maintain a level lift as the boom is raised or lowered.

In one embodiment, the stored boom/bucket ratio 186 includes a single ratio which associates an angle of the bucket with respect to the boom based on boom height or velocity of the bucket with respect to velocity of the boom. This single ratio represents an average ratio of the relative position, angle, or velocity between the boom and the bucket, position, angle, or velocity. While in one embodiment, a single ratio is defined, in other embodiments two or more ratios are contemplated such that a defined boom height refers to a defined angular displacement of the bucket.

The processor 160, upon receipt of the commanded boom/bucket velocity ratio at block 184, accesses and/or retrieves relational data representative of the physical or operational relationship between the boom and bucket locations. For instance, in one embodiment, the relational data includes a relationship between the boom height to bucket angular location at block 188. As the bucket is moved, higher for instance, the angular location of the bucket changes to reduce or prevent lost contents. Because the commanded boom/bucket velocity ratio 184 is configured to move both the boom and bucket through a range of motion at a certain velocity, the processor 160 at block 190 modifies the bucket command generated by the bucket operator control 156 to maintain a level bucket throughout the movement of the boom 108.

In one example, after the operator has filled and moved the bucket to a level condition, the operator raises the boom 108. In this example, the bucket command 166 is zero and only a boom command 164 is generated in response to the operator's movement of the joystick. The modified bucket command 190 is therefore based only on the bucket velocity. The modified bucket command provides an upper limit for the operator's bucket command. This ensures that there is no unintended motion of the bucket. For instance, in one embodiment, if the operator provides a 100% command for a bucket dump as the boom is raised, the controller 154 reduces the operator's bucket command to a smaller value to provide a level lift. In other embodiments, the modified bucket command is no greater than the operator's bucket command. If, however, the operator is commanding movement of the bucket as the position of the boom is being adjusted, the commanded boom bucket velocity ratio 184 includes values representing both the commanded boom velocity and the commanded bucket velocity. In this example, the bucket command is a modified bucket command 190 which adjusts the position of the bucket based on the boom 108.

The boom command is independent of other motions and is considered as an independent variable. The modified bucket command, which provides an upper limit to an operator provided bucket command, is a dependent variable based on the boom command.

In one example, the bucket position is adjusted based on the movement of the boom as provided by the operator. If the operator actuates the bucket with either a curl or dump command, the bucket command is modified based on the boom command to compensate for the movement of the commanded boom. In another example, the bucket command is command having an upper limit where the operator pulls full bucket command in either direction when modulating the boom command. The controller 154 modulates the bucket command up to the limit imposed by the operator bucket command.

The modified bucket command 190 is transmitted to the tilt hydraulic actuators 114 and the boom command 182 is transmitted to the hydraulic actuators 120. Each of the actuators responds to the appropriate signals to maintain a relatively level bucket such that there is no loss of bucket contents or a minimal loss of bucket contents during movement of the boom 108, and therefore the bucket 106.

In another embodiment of the open loop electrohydraulic bucket position control system, the boom lookup table 164 includes a number of boom velocity values, each of which is associated with an operator boom command. Once the controller 154 receives the command signal from the boom operator control 158, the processor 160 selects from the memory 162 storing the boom lookup table 164, one of the boom velocity values associated with the operator boom command. The selected boom velocity value is then multiplied by a bucket/boom velocity ratio to arrive at a bucket self-level velocity.

The bucket/boom velocity ratio 184 is selected from the boom/bucket ratio memory location 186. The boom/bucket velocity ratio is determined as a function of the boom height and a related bucket angle which provides for a level bucket at every value of boom height. In one embodiment, the ratio is a constant value for both raising the boom and lowering the boom. In another embodiment, two ratios are used, one for raising the boom and another for lowering the boom.

The bucket self-level velocity is then used to provide a bucket self-level command. Once the bucket self-level command is determined, the bucket self-level command is used to modify the operator bucket command as shown at block 190. The modified bucket command 190 and the operator boom command 182 are then used to adjust the position of the boom while maintaining the bucket at a level position.

Figure 4:
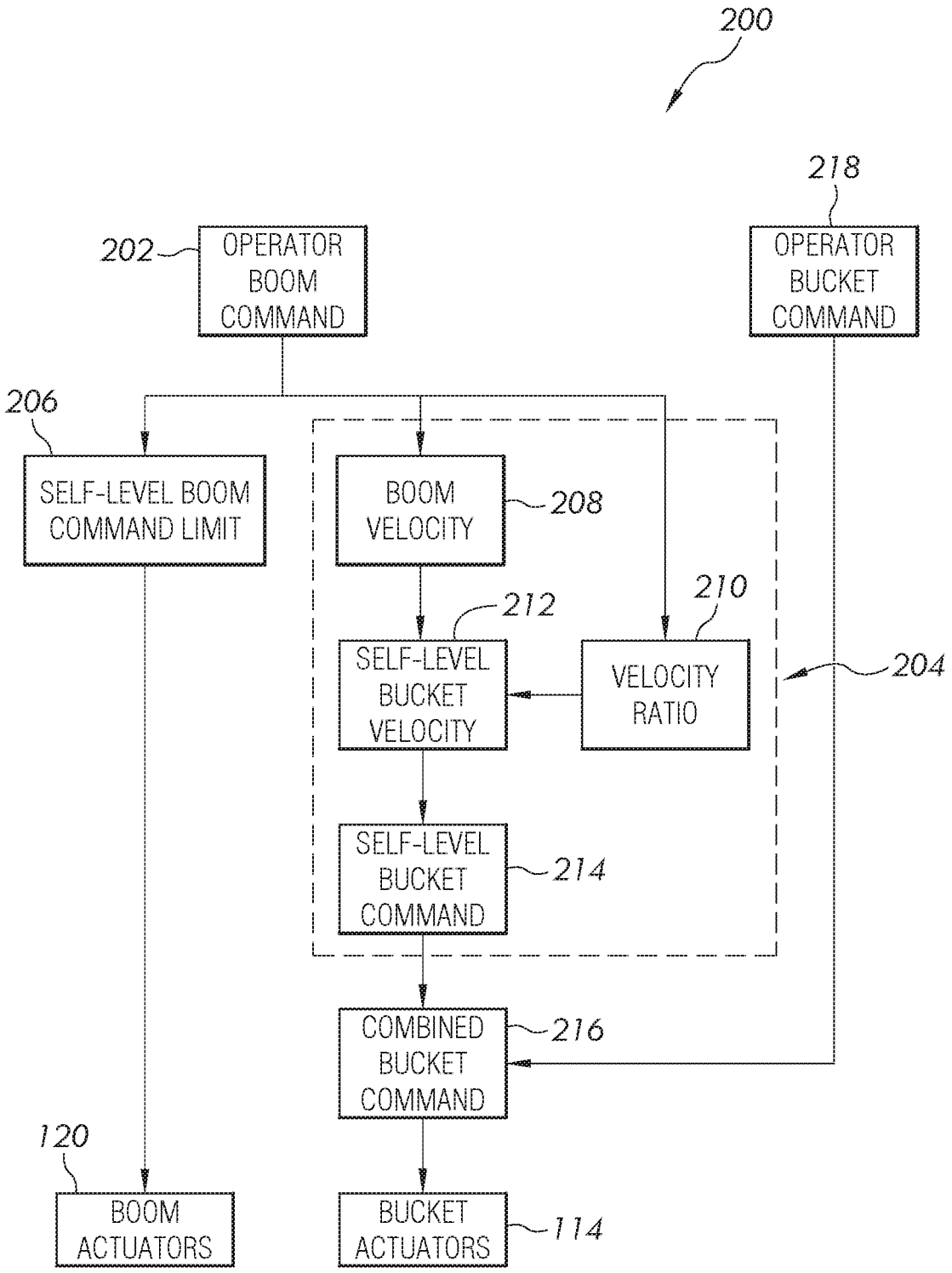
FIG. 4 is a flow diagram of another embodiment for controlling the position of a bucket for a loader machine.

FIG. 4 illustrates a flow diagram of another embodiment for controlling the position of a bucket for a loader machine. As illustrated in FIG. 4, the operator using the joystick 50 provides an operator boom command at block 202. The operator boom command 202 is transmitted to the controller 154 which is configured to determine a self-level bucket command at block 204. The self-level bucket 204 command is a function of only the boom command 202 in this embodiment. The self-level bucket command 204 is based on a predetermined bucket/boom cylinder velocity ratio. The bucket/boom cylinder velocity ratio is based on the boom command 202 and/or a boom commanded direction. In one embodiment, the self-level bucket command 204 is a single lookup table stored in the memory 162, which determines the self-level bucket command based on the boom command.

Additionally, the operator boom command 202, in some embodiments, is limited by the controller 154 with a self-level boom command limit 206. Under some conditions, the transmitted boom command 202 could adjust the boom actuators 120 too quickly, such that the bucket cannot remain sufficiently level. In the event that the bucket 106 cannot be adjusted quickly enough to maintain the bucket at the level condition, the boom velocity is limited by the self-level boom command limit 206. The self-level boom command limit 206 is stored in the memory 162. The controller 154 would limit the boom velocity requested by the operator through the joystick 50 using the boom command limit 206. The operator boom command 202, including the boom command limit if used, commands movement of the boom actuator 120.

In the illustrated embodiment, the self-level bucket command 204 is determined based on a boom velocity 208 and a velocity ratio 210. The boom velocity 208 is determined as a function of the boom command 202, which adjusts fluid flow to the actuator valve to move the actuator at a boom velocity based on the boom command. The boom velocity 208, in one embodiment, is stored in a lookup table which corresponds to the transmitted boom command.

The boom command 202 is also used to determine a velocity ratio 210. The boom velocity ratio is a ratio based on values of the boom cylinder velocity that correspond to values of bucket cylinder velocities. In different embodiments, the velocity ratio is stored in a lookup table or in other memory. This velocity ratio is determined to maintain a level bucket angle during movement of the boom. In one embodiment, the velocity ratio is a constant value for both raising and lowering the boom. In another embodiment, the velocity ratio is a first constant value for raising the boom and a second constant value for lowering the boom. In different embodiments a plurality of ratios is contemplated.

Once the velocity ratio 210 is determined, the boom velocity 208 and the velocity ratio 210 are used to determine a self-level bucket velocity at block 212. The self-level bucket velocity 212 determines a velocity of the bucket required maintain the level position of the bucket based solely on the operator boom command 202. Once the bucket velocity 212 is determined, a self-level bucket command is determined at block 214.

The self-level bucket command 214, which is determined by the processor 160, is then modified if necessary at block 216 to provide a combined bucket command based on the self-level bucket command and an operator bucket command 218. The operator bucket command 218 is a bucket velocity command provided by the operator which determines the velocity of the bucket actuator. In at least one embodiment, an initial bucket command provided by the operator is used to set the bucket at a level condition before the operator starts to adjust the position of the boom. By setting the bucket to a level condition, the combined bucket command 216 determines the level of the bucket based on the initial level condition.

If the operator is not commanding the bucket to move independently of the movement of the boom, the combined bucket command 216 is only based on the determined self-level bucket command and is unmodified. For instance, as the boom is raised, the bucket position is automatically and continuously adjusted to tilt away from the operator. If the boom is lowered, however, the bucket position is continuously adjusted to tilt toward the operator.

If the operator is directing movement of the bucket at the same time as movement of the boom is occurring, the combined bucket command 216 is a modified bucket command. In one embodiment, as the boom is being raised or lowered, and the operator requests a curl operation, the combined bucket command adjusts the bucket in the curl direction, by subtracting from, or reducing the value of, the bucket command. If during a dump operation when the boom is being raised or lowered, the combined bucket command adjusts the position of the bucket in the dump direction by adding to, or increasing the value of, the dump command. Once the combined bucket command is determined, the combined bucket command is transmitted to the bucket actuator 114 to adjust the position of the bucket. The result of the combined bucket command to either dump or curl during movement of the boom is that the orientation of the bucket will deviate from a level position in the direction and at the rate requested by the operator using the bucket operator control.

The disclosed open loop electrohydraulic bucket position control system provides for movement of material with a front loader while reducing or eliminating the need for sensors and related hardware that typically monitors boom and bucket position is a closed loop system. Due to the lack of positional sensors in the described embodiments, sensor derived positions are not generated and are therefore not available as a feedback signal to provide for the described open loop bucket position control system. The reduction or elimination of positional sensors not only reduces costs, but also reduces the complexity of hardware and information processing required in a closed-loop system. A reduction in maintenance costs is also achieved.

The described system and method utilize the commanded spool position of the boom actuators and intrinsically gathered data from the simulated linkage motion to command a bucket spool that maintains a relatively constant angle of the bucket with respect to a grounded observer. The need for sensors and a feedback loop, either electrical or mechanical, is eliminated and instead relies on empirically gathered data and a software controlled process provided by the stored program instructions to adjust the position of the bucket as the boom moves.

While exemplary embodiments incorporating the principles of the present disclosure have been described hereinabove, the present disclosure is not limited to the described embodiments. Instead, this application is intended to cover any variations, uses, or adaptations of the disclosure using its general principles. Further, this application is intended to cover such departures from the present disclosure as come within known or customary practice in the art to which this disclosure pertains and which fall within the limits of the appended claims.

The invention claimed is:

1. An electrohydraulic bucket position control system for a work vehicle having a boom operator control configured to transmit an operator boom command to adjust a position of a boom and a bucket operator control configured to transmit an operator bucket command to adjust a position of a bucket, the control system comprising:

a boom hydraulic actuator operatively connected to the boom operator control;

a bucket tilt hydraulic actuator operatively connected to the bucket operator control;

a controller operatively connected, to the boom operator control and to the bucket Operator control, the controller including a processor and a memory, wherein the memory is configured to store program instructions, bucket data, boom data, and boom and bucket relational data, wherein the memory includes at least one stored lookup table, wherein the stored lookup table includes one of the stored bucket data, stored boom data, and the boom and bucket relational velocity data including at least one velocity ratio, wherein the at least one velocity ratio is representative of a velocity of the bucket with respect to a velocity the boom, and the processor is configured to execute the stored program instructions to:

determine a boom velocity of the boom based, on the operator boom command;

determine a bucket velocity of the bucket based on the operator bucket command; and determine a combined bucket command based on the boom velocity and bucket velocity to arrive at the combined bucket command, wherein the bucket velocity is at least one of an angular and linear velocity, and wherein the combined bucket command determines a velocity of the bucket based on the determined boom velocity and the at least one velocity ratio.

2. The control system of claim 1 wherein the stored bucket data includes a plurality of bucket commands, wherein each of the bucket commands is configured to maintain the bucket substantially level.

3. The control system of claim 1 wherein the stored boom data includes a plurality of boom commands, wherein each of the boom commands is associated with a specific boom velocity.

4. The control system of claim 1 wherein the stored boom data includes a plurality of boom commands, wherein each of the boom commands is associated with a height of the boom with respect to a frame of the work vehicle.

5. The control system of claim 1 wherein the at least one ratio includes a single ratio representative of the boom being both raised and lowered.

6. The control system of claim 1 wherein the at least one ratio includes a first ratio representative of the boom as the boom is raised and a second ratio representative of the boom as the boom is lowered.

7. A front end loader including a frame comprising;

a ground engaging traction member operatively connected to the frame;

a cab operatively connected to the frame, the cab being configured to be occupied by an operator;

a boom operatively connected to the frame;

a bucket rotationally coupled to the boom;

a bucket tilt hydraulic actuator operatively connected to a bucket operator control providing a bucket tilt command;

a boom hydraulic actuator operatively connected to a boom operator control providing a boom command;

a controller operatively connected to the boom operator control and to the bucket operator control, the controller including a processor and a memory, wherein the memory is configured to store program instructions and the processor is configured to execute the stored program instructions to:

determine a velocity of the boom based on the boom command generated by the boom operator control;

determine a velocity of the bucket based on the bucket command generated by the bucket operator control;

determine a commanded boom and bucket velocity ratio based on the boom command;

determine a required boom and bucket ratio for a level lift;

determine a combined bucket command based on the commanded boom and bucket velocity ratio and the requited boom and bucket ratio; and adjust the bucket hydraulic actuator with the combined bucket command.

8. The front end loader of claim 7 wherein the determine a commanded boom and bucket velocity ratio includes determine the commanded boom and bucket velocity ratio based on a plurality of the boom commands each associated with a boom velocity and a plurality of the bucket commands each associated with the bucket velocity.

9. The front end loader of claim 8 wherein the memory is further configured to store a first lookup table arranged to include the plurality of boom commands each associated with the boom velocity and a second lookup table arranged to include the plurality of bucket commands each associated with a bucket velocity.

10. The front end loader of claim 9 wherein the memory is further configured to a store the required boom and bucket velocity ratio for a level lift.

11. The front end loader of claim 10 wherein the processor is configured to execute the stored program instructions to: determine the combined bucket command by accessing the first and second lookup tables to generate the commanded boom and bucket velocity ratio.

12. The front end loader of claim 11 wherein the processor is configured to execute the stored program instructions to: determine the combined bucket command by accessing the stored required boom and bucket ratio for a level lift to generate the commanded boom and bucket velocity ratio.

13. The front end loader of claim 12 wherein the processor is figured to execute the stored program instructions to: adjust the bucket hydraulic actuator based on the combined bucket tilt command.

14. The front end loader of claim 7 wherein the determine the combined bucket command includes determine the combined bucket command in the absence of a sensor signal generated by a sensor located at one of the boom or at the bucket.

15. A method of adjusting a position of an implement operatively connected to a boom of a front end loader wherein a position of the implement is made in response to a boom command and the position of the implement is made in response to an implement command, the method comprising:

identifying a first velocity of the boom based on the boom command;

identifying a second velocity of the implement based on the implement command;

determining a commanded velocity ratio based on the identified first velocity and the identified second velocity; and determining a modified implement command based on the commanded velocity ratio, wherein the modified implement command adjusts the position of the implement with respect to the boom.

16. The method of claim 15 further comprising determining relational data representative of the physical or operational relationship between a plurality or positions of the implement and an associated implement position at each of the plurality of positions of the implement to generate a boom/implement ratio for a level lift of the implement at each of the plurality of positions of the boom.

17. The method of claim 16 wherein the determining a modified implement command includes determining the modified implement command based on the generated boom/implement ratio for a level lift.

* * * * *